US011359808B2

(12) United States Patent
Rennie et al.

(10) Patent No.: US 11,359,808 B2
(45) Date of Patent: Jun. 14, 2022

(54) BURNER FOR THE COMBUSTION OF PARTICULATE FUEL

(71) Applicant: Metso Minerals Oy, Tampere (FI)

(72) Inventors: Clifford John Rennie, Didcot (GB); Christopher Phillip Sansom, Rickmansworth (GB); Clayton Holmes, Powick (GB)

(73) Assignee: Metso Minerals Oy, Tampere (FI)

( * ) Notice: Subject to any disclaimer, the term of this patent is extended or adjusted under 35 U.S.C. 154(b) by 80 days.

(21) Appl. No.: 14/909,327

(22) PCT Filed: Aug. 1, 2014

(86) PCT No.: PCT/EP2014/066603
§ 371 (c)(1),
(2) Date: Feb. 1, 2016

(87) PCT Pub. No.: WO2015/094565
PCT Pub. Date: Jun. 25, 2015

(65) Prior Publication Data

US 2017/0138589 A1 May 18, 2017

(30) Foreign Application Priority Data

Aug. 2, 2013 (GB) ..... 1313842

(51) Int. Cl.
*F23D 1/02* (2006.01)

(52) U.S. Cl.
CPC ..... *F23D 1/02* (2013.01); *F23D 2201/20* (2013.01); *F23D 2900/01001* (2013.01)

(58) Field of Classification Search
CPC ..... F23R 2900/03281
USPC ..... 431/9
See application file for complete search history.

(56) References Cited

U.S. PATENT DOCUMENTS

| | | | | |
|---|---|---|---|---|
| 1,678,225 A * | 7/1928 | Kincade | C10G 17/00 366/338 |
| 1,947,866 A * | 2/1934 | McCourt | F23D 14/00 431/284 |
| 2,325,318 A * | 7/1943 | Hendrix | F23D 1/02 431/174 |
| 2,800,888 A * | 7/1957 | Miller | F23C 99/00 122/479.1 |

(Continued)

FOREIGN PATENT DOCUMENTS

| | | |
|---|---|---|
| CN | 102537951 | 7/2012 |
| EP | 2187123 | 5/2010 |

(Continued)

*Primary Examiner* — Avinash A Savani
(74) *Attorney, Agent, or Firm* — Andrus Intellectual Property Law, LLP

(57) ABSTRACT

This invention relates to a burner (1) for burning a suspension of solid fuel in oxygen containing gas. A portion of the suspension is passed through a first conduit (10) which contains a bluff body (12) and helical vanes to impart turbulence and swirl to the suspension. A further portion of the suspension is passed through a second conduit (40) which is coaxial with the first conduit. Means for varying the relative sizes of each portion are provided. The arrangement allows improved fuel/air mixing, flame shape, heat transfer and control of NOx emissions.

15 Claims, 2 Drawing Sheets

(56) References Cited

U.S. PATENT DOCUMENTS 3,731,876 A * 5/1973 Showalter ..... B05B 9/005 239/13
4,007,000 A * 2/1977 Graffman ..... F23D 11/24 239/102.2
4,257,762 A * 3/1981 Zink ..... F23D 14/34 431/177
4,274,343 A * 6/1981 Kokkinos ..... F23D 1/00 110/106
4,301,966 A * 11/1981 Schwarz ..... F23D 11/44 239/135
4,412,496 A * 11/1983 Trozzi ..... F23K 3/02 101/347
4,425,855 A * 1/1984 Chadshay ..... F23C 7/02 110/263
4,455,982 A * 6/1984 Hafner ..... F02M 51/005 239/124
4,471,703 A * 9/1984 Vatsky ..... F23K 3/02 110/106
4,566,393 A * 1/1986 Connell ..... F22B 31/045 110/101 CA
4,570,549 A * 2/1986 Trozzi ..... F23K 3/02 110/106
4,621,582 A * 11/1986 Cooper ..... F23D 1/02 110/263
4,651,928 A * 3/1987 Schmidt ..... F23C 7/008 239/133
4,773,586 A * 9/1988 Ryan ..... F24H 9/2085 236/11
4,840,163 A * 6/1989 Alsobrooks ..... F02M 51/0614 123/452
4,924,784 A * 5/1990 Lennon ..... F23D 1/02 110/106
5,158,261 A * 10/1992 Morohoshi ..... F23D 11/26 251/129.15
5,199,355 A * 4/1993 Larue ..... F23D 1/02 110/261
5,392,720 A * 2/1995 Briggs ..... F23D 1/02 110/264
5,456,594 A * 10/1995 Yap ..... F23C 15/00 431/1
5,460,330 A * 10/1995 Steeb ..... F23D 11/44 239/133
5,697,306 A * 12/1997 LaRue ..... F23D 1/02 110/261
5,829,367 A * 11/1998 Ohta ..... F23D 1/00 110/261
6,059,560 A * 5/2000 Richards ..... F23D 14/74 431/1
6,148,743 A * 11/2000 Vatsky ..... F23M 9/02 110/297
6,152,051 A * 11/2000 Kiyama ..... F23D 1/00 110/104 B
6,439,136 B1 * 8/2002 Mann ..... F23D 1/00 110/263
6,637,674 B1 * 10/2003 Mistier ..... F02B 43/00 239/288
7,028,622 B2 * 4/2006 Taylor ..... F23C 6/045 110/265
8,726,819 B2 * 5/2014 Tamura ..... F23C 7/004 110/104 B
2003/0140614 A1 * 7/2003 Nearhoof, Sr. ..... F02C 9/28 60/39.281
2003/0177764 A1 * 9/2003 Kamen ..... F23D 11/26 60/517
2008/0264310 A1 10/2008 Jia et al.
2009/0277364 A1 * 11/2009 Donais ..... F23D 1/00 110/263
2011/0139048 A1 * 6/2011 Tamura ..... F23C 7/004 110/262
2012/0247376 A1 10/2012 Matsumoto et al.
2014/0114483 A1 * 4/2014 Haugstetter ..... F23N 5/00 700/274

FOREIGN PATENT DOCUMENTS

FR 2773388 7/1999
WO 02057689 7/2002

* cited by examiner

BURNER FOR THE COMBUSTION OF PARTICULATE FUEL

CROSS REFERENCE TO RELATED APPLICATION

The present application is the U.S. national stage application of International Application No. PCT/EP2014/066603, filed Aug. 1, 2014, which international application was published on Feb. 5, 2015, as International Publication No. WO 2015014989 in the English language. The International Application claims priority of GB Patent Application No. 1313842.5, filed Aug. 2, 2013.

BACKGROUND

This invention relates to burners more especially but not exclusively the invention relates to burners for burning solid materials such as coal dust or pet-coke. Typically these burners are used in making cement, for lime-burning, for metal reduction or use on lime recovery kilns in paper-making. The invention is not so limited.

SUMMARY

According to the invention there is provided a burner for solid fuel the burner comprising a) a first conduit;
b) a bluff body received in the first conduit;
c) means for passing a suspension of solid fuel in an oxygen containing gas through the first conduit;
d) a plurality of vanes received in the first conduit and inclined to the axis of the first conduit for imparting swirl to the suspension of solid fuel in an oxygen containing gas as it passes through the first conduit;
e) the first conduit being received in a second conduit and
f) means for passing a suspension of solid fuel in an oxygen containing gas through the second conduit.

The bluff body can have a cylindrical cross-section. The downstream end of the bluff body can have a face angle α in the range 80 to 110°. The bluff body can have a tapered nose portion which has a length 2 to 10 times the internal diameter of the first conduit. The bluff body can have a parallel sided portion which has a length 2 to 10 times the internal diameter of the first conduit. The maximum cross-sectional area of the bluff body is typically 50 to 90% of the internal cross sectional area of the first conduit. The bluff body can be provided with 2 to 10 vanes inclined relative to the axis of the first conduit.

The burner may further comprise a plenum in fluid connection with the first conduit and the second conduit. The plenum can be provided with adjustment means such as an adjustable damper for varying the relative proportions of the suspension of solid fuel in an oxygen containing gas which enter the first conduit and which enter the second conduit.

The invention further provides a method of burning a solid material comprising passing a suspension of solid fuel in an oxygen containing gas through first and second conduits of a burner of the invention and igniting it.

BRIEF DESCRIPTION OF THE DRAWINGS

Embodiments of the invention will be described by reference to the accompanying figures of which FIG. 1 which is a schematic view of a first embodiment of the invention and FIG. 2 which is a schematic view of a second embodiment of the invention.

DETAILED DESCRIPTION

Figure 1:
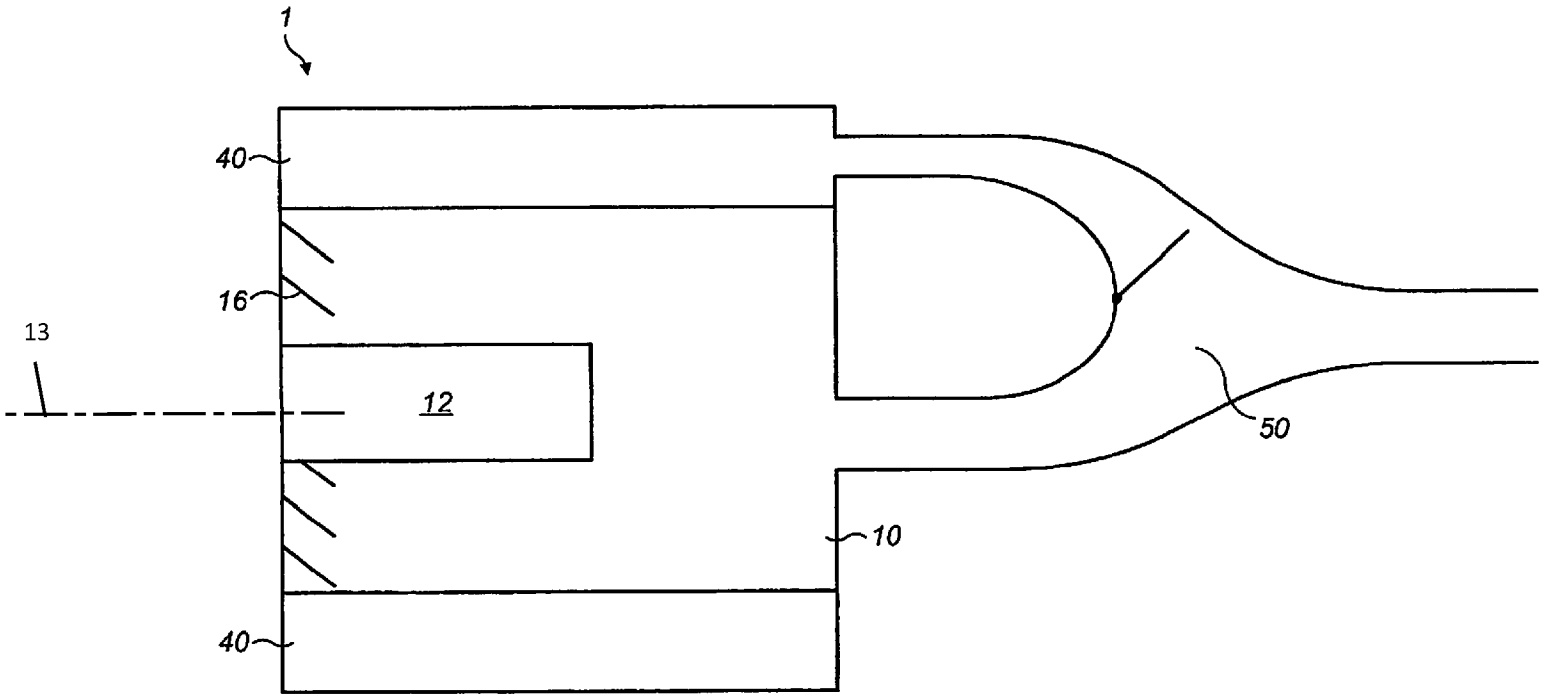

Burner 1 comprises a first conduit 10 which is capable of passing a suspension of solid particles such as fuel in a gas such as an oxygen containing gas such as air. Typical fuels include coal, pet coke and biomass. The invention is not restricted to a particular solid fuel.

Typically the suspension of solid material in gas is a direct result of comminution of the solid fuel without intermediate separation of fuel from the grinding mill airstream. Typically the first conduit is of circular cross-section but this is not essential. Those skilled in the art will have no difficulty in devising means of passing the suspension through the conduit.

Received in the first conduit 10 is bluff body 12. Bluff body 12 is typically centred in and along an axis 13 of the first conduit 10 but it need not be so. Bluff bodies themselves are well known and are objects where fluid flowing past them experience drag forces which are dominated by pressure drag i.e. the formation of eddies and vortices in distinction to streamlined bodies where fluid passing over the body experiences drag forces which are dominated by frictional forces between the fluid and the body. Typically therefore bluff bodies have blunt downstream ends 14. In the figures the bluff body is shown as a block but this is not essential and it could for example be a cylindrical disc. In other embodiments of the invention the bluff body may comprise one or more cylindrical rods disposed with their axis broadly transverse to the axis of the first conduit 10.

A preferred bluff body is cylindrical in cross-section. A preferred bluff body 12 has a cross sectional area which is 50 to 90% such as 60 to 80% such as 70 to 75% of the internal cross sectional area of the first conduit 10 at its largest portion. A preferred bluff body has a downstream end 14 where the face angle α between the blunt end 14 and the side of the bluff body 15 is in the range 80 to 110° such as 85 to 100° such as 90 to 95°. A preferred bluff body has a tapered nose portion 16 which may have a length of 2 to 10 for example 3 to 8 times the internal diameter of the first conduit. A preferred bluff body has a parallel sided portion extending between the nose portion and the blunt end which parallel sided portion has a length of 2 to 10 for example 3 to 8 times the internal diameter of the first conduit. A particularly preferred bluff body is cylindrical in cross section with a cross sectional area which is 70 to 80% of the internal cross sectional area of the first conduit, a downstream end with a face angle α which is 90 to 95°, a nose portion which has a length of 3 to 5 times the internal diameter of the first conduit and a parallel sided portion intermediate the nose portion and blunt end which has a length 3 to 5 times the internal diameter of the first conduit.

As the suspension passes through the first conduit 10 and around the bluff body 12 it will experience drag forces such as eddies and vortices resulting in good mixing of the suspension.

Figure 2:
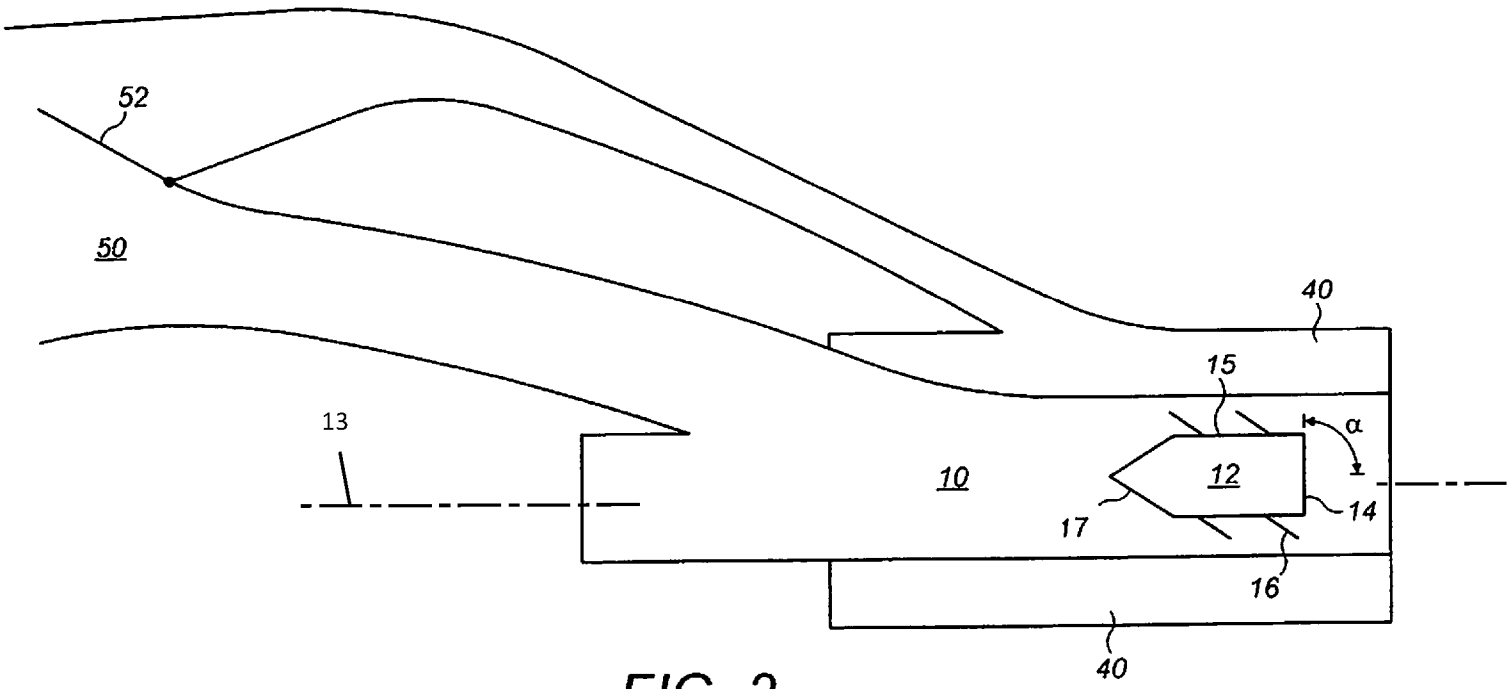

First conduit 10 is further provided with means for imparting swirl to the suspension as it passes through the conduit. Swirl is flow with a helical component i.e. with a rotational movement. One way this can be achieved is by providing inclined vanes 16 in the first conduit 10 as shown in FIG. 1. The inclined vanes are inclined to the axis 13 of the first conduit. Typically 2 to 10 such as 3 to 6 inclined vanes are provided. In the illustrated embodiment the vanes are straight but this is not essential and curved or aerofoil shaped vanes could be provided. Another way of doing this is shown in FIG. 2 where swirl inducing members or vanes 16 are provided on the bluff body 12. In other embodiments inclined vanes or helical strakes are carried both by the inside of the first conduit and on the outside of the bluff body. In many embodiments of the invention the vanes are symmetrically disposed.

First conduit 10 is received in second conduit 40. Generally the first and second conduits are coaxial but this is not essential. Again generally the second conduit will be cylindrical but this is not essential. Means for supplying a suspension of solid material such as fuel in an oxygen containing gas such as air to the second conduit 40 is provided. Typically the suspension passing through the second conduit is the same as that passing through the first conduit but this too is not essential.

In the illustrated embodiment material passing through the second conduit flows principally axially with little or no swirl component. In contrast to existing direct fired solid fuel burners swirl and axial gas flows are separated. This leads to allows improved fuel/air mixing, flame shape, heat transfer and control of NOx emissions.

It is not however essential for the material exiting the second conduit to flow purely axially. Indeed embodiments of the invention are provided with means for imparting swirl to material exiting the second conduit. This can be achieved for example by providing one or more surfaces of the second conduit with helical strakes. The amount of swirl can thereby be controlled to give improved flame properties.

In embodiments of the invention means for adjusting the amount of swirl applied to material exiting either or both the first conduit or the second conduit are provided. A way of doing this is by altering the inclination of the vanes.

Preferably the burner is provided with a plenum 50. Fuel and air and air suspension passes through the plenum on the way to the first conduit 10 and second conduit 40. Preferably the plenum is provided with means for altering the relative proportions of the suspension passing through the first and second conduits. This allows further tuning of the burner. A convenient way of doing this is by providing the plenum 50 with an adjustable damper 52.

The invention claimed is:

1. A burner for solid fuel, the burner comprising:

a first conduit capable of passing a suspension of solid fuel in an oxygen containing gas;

a bluff body received in the first conduit, wherein the bluff body has an axial extension being smaller than an axial extension of the first conduit, the bluff body further having a blunt downstream end and a cylindrical cross section;

a plurality of vanes received in the first conduit, the plurality of vanes being provided on an outer surface of the bluff body, and being inclined to an axis of the first conduit for imparting swirl to the suspension of solid fuel in an oxygen containing gas as it passes through the first conduit;

the first conduit being received in a second conduit capable of passing at least a portion of the suspension of solid fuel in the oxygen containing gas; and a plenum in fluid connection with the first conduit and the second conduit, wherein the plenum is provided with an adjustable damper for varying proportions of the suspension of solid fuel in an oxygen containing gas which enter the first conduit relative to the proportions of the suspension of solid fuel in an oxygen containing which enter the second conduit.

2. A burner as claimed in claim 1 wherein a downstream end of the bluff body has a face angle $\alpha$ in a range 80 to 110°.

3. A burner as claimed in claim 1 wherein the bluff body has a tapered nose portion which has a length 2 to 10 times an internal diameter of the first conduit.

4. A burner as claimed in claim 1 wherein the bluff body has a parallel sided portion which has a length 2 to 10 times an internal diameter of the first conduit.

5. A burner as claimed in claim 2 wherein a maximum cross-sectional area of the bluff body is 50 to 90% of an internal cross sectional area of the first conduit.

6. A method of burning a solid material comprising passing a suspension of solid fuel in an oxygen containing gas through first and second conduits of a burner as claimed in claim 1 and igniting the mixture.

7. A burner as claimed in claim 2 wherein the bluff body has a tapered nose portion which has a length 2 to 10 times an internal diameter of the first conduit.

8. A burner as claimed in claim 2 wherein the bluff body has a parallel sided portion which has a length 2 to 10 times an internal diameter of the first conduit.

9. A burner as claimed in claim 2 wherein a maximum cross-sectional area of the bluff body is 50 to 90% of an internal cross sectional area of the first conduit.

10. A burner as claimed in claim 2 wherein a maximum cross-sectional area of the bluff body is 50 to 90% of an internal cross sectional area of the first conduit.

11. A burner as claimed in claim 2 wherein the plurality of vanes comprises 2 to 10 vanes inclined relative to the axis of the first conduit provided on the bluff body.

12. The method as claimed in claim 6 wherein the bluff body has a cylindrical cross-section.

13. The method as claimed in claim 12 wherein the downstream end of the bluff body has a face angle $\alpha$ in the range 80 to 110°.

14. A method as claimed in claim 6 wherein a maximum cross-sectional area of the bluff body is 50 to 90% of an internal cross sectional area of the first conduit.

15. A method as claimed in claim 12 wherein a maximum cross-sectional area of the bluff body is 50 to 90% of an internal cross sectional area of the first conduit.

* * * * *